United States Patent [19]

Maryonovich

[11] Patent Number: 4,483,515

[45] Date of Patent: Nov. 20, 1984

[54] LIFTING JACK AND COVER THEREFOR

[75] Inventor: Michael C. Maryonovich, Whitefish Bay, Wis.

[73] Assignee: Masco Corporation, Taylor, Mich.

[21] Appl. No.: 411,710

[22] Filed: Aug. 26, 1982

[51] Int. Cl.[3] ..... B66F 3/18

[52] U.S. Cl. ..... 254/103; 74/609

[58] Field of Search ..... 254/103, 98, 126; 74/609

[56] References Cited

U.S. PATENT DOCUMENTS

| | | | |
|---|---|---|---|
| 880,113 | 2/1908 | Voss | 74/609 |
| 1,326,661 | 12/1919 | Hewitt et al. | 74/609 |
| 1,659,785 | 2/1928 | Rodman et al. | 254/103 |
| 2,512,528 | 6/1950 | Holman | 74/609 |

FOREIGN PATENT DOCUMENTS

| | | | |
|---|---|---|---|
| 1275260 | 8/1968 | Fed. Rep. of Germany | 254/103 |
| 2403542 | 8/1975 | Fed. Rep. of Germany | 254/103 |
| 515086 | 2/1955 | Italy | 254/103 |
| 978981 | 1/1965 | United Kingdom | 254/103 |

*Primary Examiner*—Robert C. Watson

*Attorney, Agent, or Firm*—Steven L. Permut; Malcolm L. Sutherland; Leon E. Redman

[57] ABSTRACT

A lifting jack having a first tubular frame member, a second tubular frame member movably interconnected coaxially with the first frame member, and a selectively operable drive mechanism for moving the second frame member relative to the first frame member. The drive mechanism includes a shaft and a bracket fastened to the second frame member and having two aligned apertures for pivotally mounting a shaft. A protective cover is provided for the drive mechanism and is removably fastened to the shaft.

6 Claims, 9 Drawing Figures

LIFTING JACK AND COVER THEREFOR

BACKGROUND

The present invention relates to lifting devices and more particularly to hand operable lifting jacks of the telescoping tube type.

Examples of jacks of this type are disclosed in U.S. Pat. Nos. 2,565,401 (issued Aug. 21, 1951) and 3,738,613 (issued June 12, 1973). Lifting jacks are frequently provided with covers to protect the drive mechanism from the environment. Usually, the covers require tools for removal. Furthermore, the drive mechanisms are often expensive to manufacture and difficult to service.

The primary object of the present invention is to provide an inexpensive manually operable lifting jack which is easy to service. Another object of the present invention is to provide a lifting jack having an easily removable cover for the drive mechanism.

SUMMARY

The present invention provides a lifting jack for raising loads such as trailers and agricultural equipment. The lifting jack has a first tubular frame member, a second tubular frame member movably interconnected with the first frame member, and a selectively operable drive mechanism for moving the second frame member relative to first frame member.

The drive mechanism includes a bracket fastened to the second frame member. The bracket has two apertures for pivotally mounting a shaft.

A protective cover is removably fastened to shaft to protect the drive mechanism from the environment and to improve the ornamental appearance of the jack. In the preferred embodiment, the cover is formed of a resilient material and has one or two walls located near portions of the shaft. Each of the walls has a slot that is open at one of its ends and has an enlarged aperture at the other of its ends. The cap is removably snapped onto the shaft by inserting a portion of the shaft into the slot and forcing the cover against the shaft until the cover elastically deflects to permit the shaft to be seated in the enlarged aperture.

The many features, objects and advantages of the present invention will become apparent to those skilled in the art when the following detailed description of the preferred embodiment is read together with the attached drawings.

DETAILED DESCRIPTION OF THE PREFERRED EMBODIMENT

Figure 1:
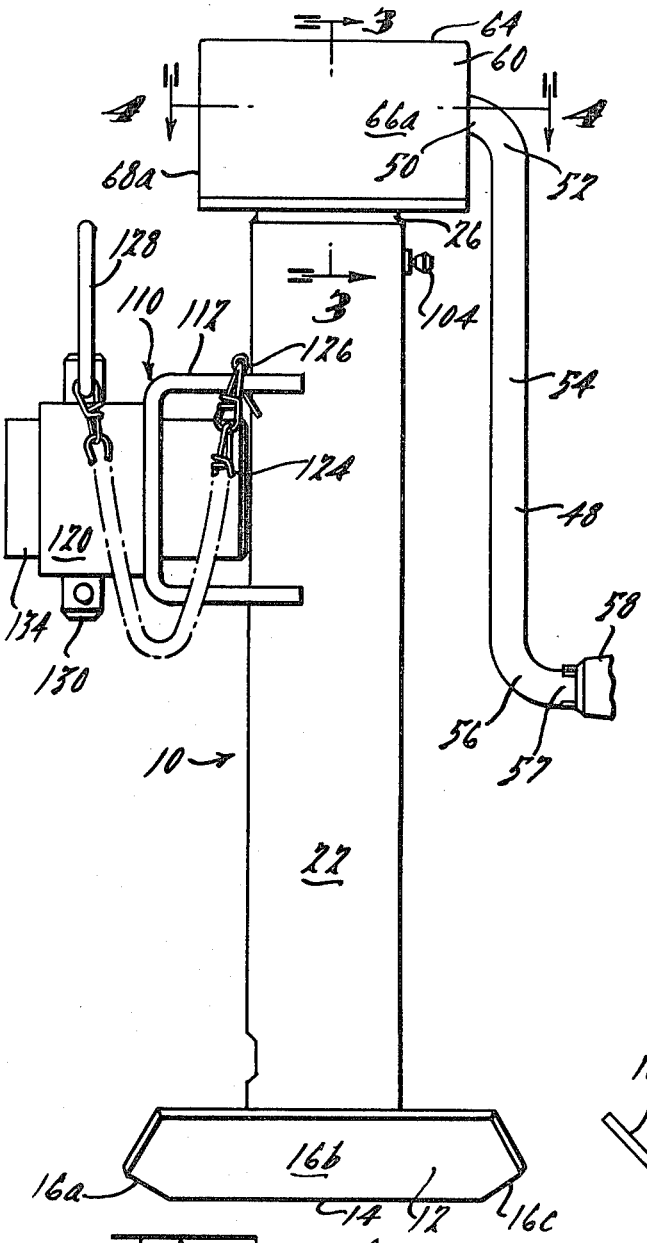
FIG. 1 is a front elevational view of the implement jack of the present invention.
Figure 2:
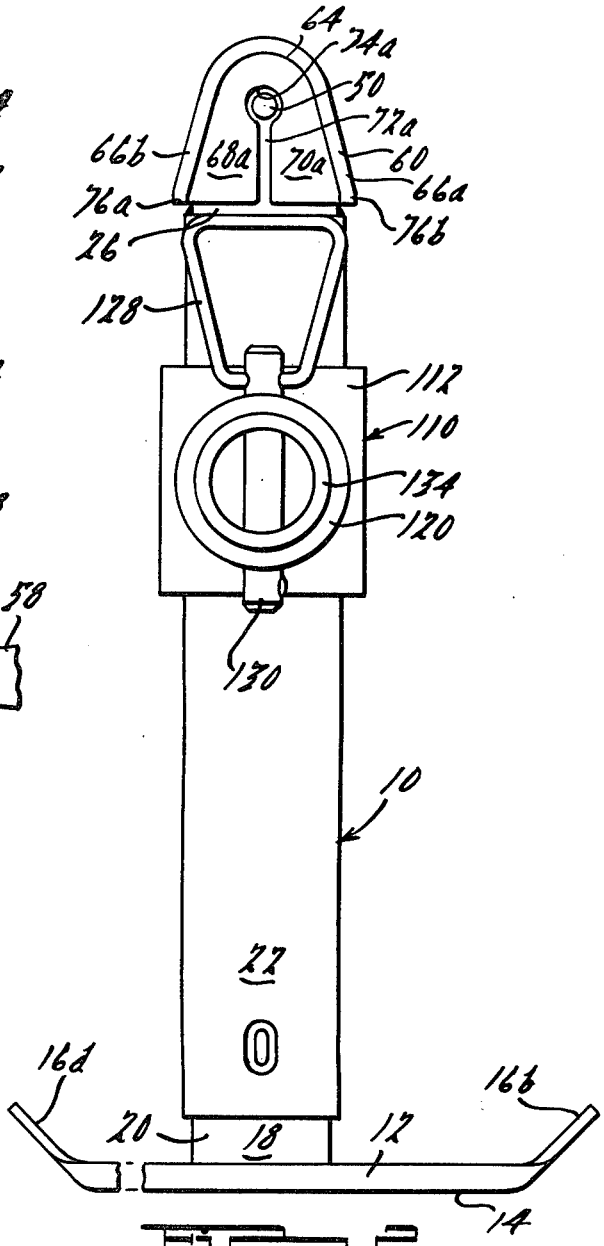
FIG. 2 is a side elevational view thereof.

Referring now to the drawing and more particularly to FIGS. 1 and 2 thereof, there is illustrated a lifting jack 10 constructed in accordance with the present invention.

Figure 3:
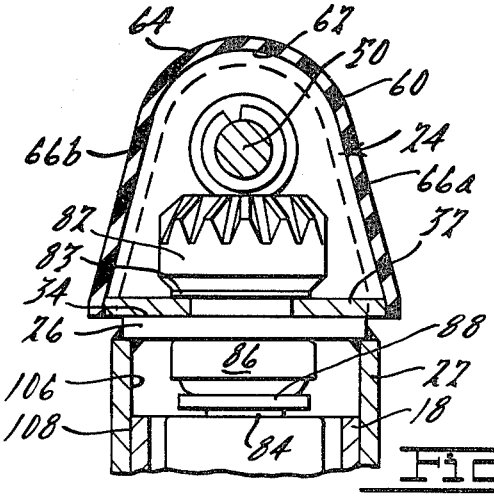
FIG. 3 is a sectional view taken along line 3—3 of FIG. 1.
Figure 5:
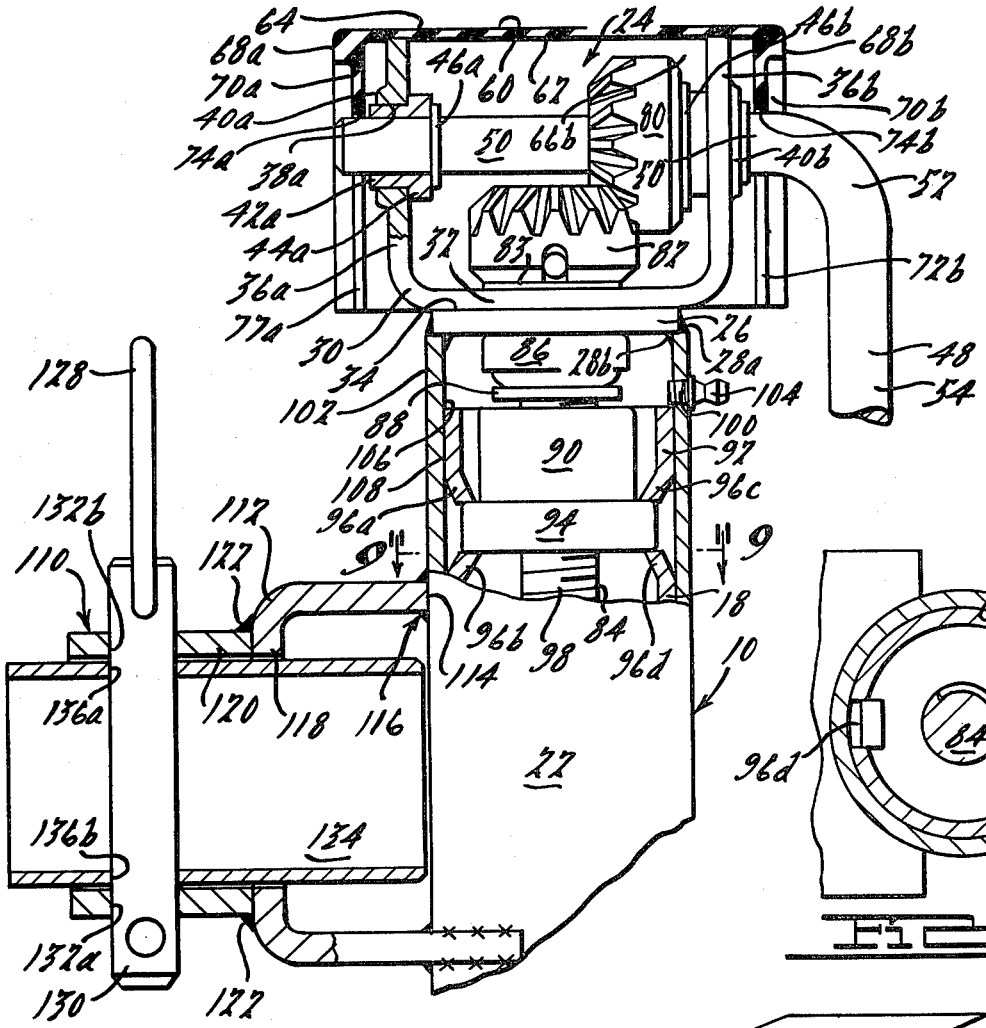
FIG. 5 is an enlarged partial front elevational view similar to FIG. 1 but with parts of the implement jack cutaway.

The lifting jack 10 has a rectangular base 12 having a flat portion 14 designed to rest horizontally upon the ground when the jack is in use. The base 12 also has four upturned edges 16*a–d*. As is well known in the art, a first tubular frame member 18 is attached, for example by welds (not illustrated), at its lower end 20 to the center of the flat portion 14 of the base 12. The upper portion of the first tubular frame member 116 is telescopically inserted into a second circular frame member 22, as illustrated in FIGS. 3 and 5. The second frame member may be reciprocated relative to the first frame member along their common longitudinal axis.

Figure 4:
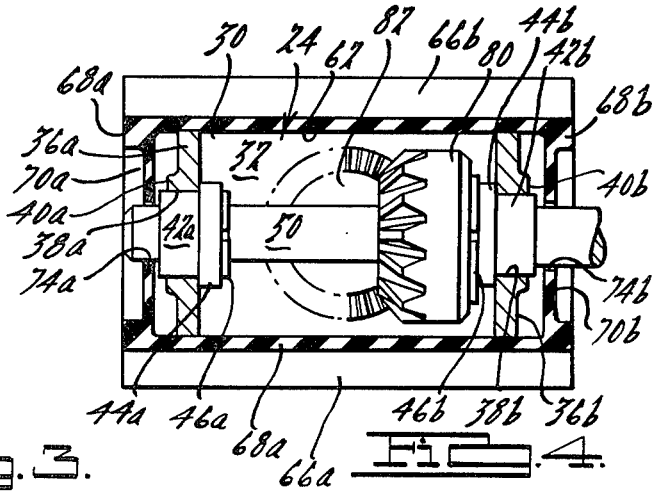
FIG. 4 is a sectional view taken along line 4—4 of FIG. 1.

A lifting mechanism 24, best illustrated in FIGS. 3–5, is provided to permit the user of the lifting jack 10 to selectively raise or lower the second frame member 22 relative to the first frame member 18.

The lifting mechanism 24 shown in the drawing includes a disk-shaped plate 26 secured by welds 28*a* and 28*b* (FIG. 5) to the uppermost end of the second tubular frame member 22. A U-shaped bracket 30 (FIG. 5) is provided having a flat central portion 32 welded or otherwise fastened to the top surface 34 of the plate 26. Alternatively (not shown) the plate 26 may be omitted and the bracket 30 may be welded directly to the second tubular frame member 22. The bracket 30 has upwardly extending arm portions 36*a* and 36*b* on either side of the central portion 32 of the bracket. A pair of aligned apertures 38*a* and 38*b* are provided through a pair of bosses 40*a* and 40*b* of the arm portions 36*a* and 36*b*, respectively. Bushings 42*a* and 42*b* having shoulders 44*a* and 44*b* are pressed into the apertures 38*a* and 38*b*, respectively. Since the bushing 42*a* experiences less of a load than the bushing 42*b*, as will be apparent to one skilled in the art, the bushing 42*a* may in some cases be omitted.

A crank 48 is provided having at one of its ends a shaft portion 50 journaled in the bushings 44*a* and 44*b*. A pair of C-clips 46*a* and 46*b* are inserted into appropriate annular channels (not illustrated) to secure the shaft 50 and the bushings 42*a* and 42*b* to the bracket 30. The crank 48 is formed from a single length of tubing or round stock, as shown in FIG. 1. The crank 48 has the shaft portion 50, a ninety degree (90°) bend (shown at 52), an arm portion 54, a second ninety (90°) degree bend (shown at 56) and, at its end furthest from the shaft portion 50, a handle portion 57. A handle 58 is interconnected with the handle portion 57 of the crank 48.

A cover 60, shown in elevation in FIGS. 1 and 2, is fitted over the bracket 30 and the shaft 50 to partly enclose the lifting mechanism 24. As shown in the sectional views of FIGS. 3 and 4, the cover 60 is a hollow element formed of a resilient material. The specific aesthetic details of the exterior surface of the cover 60 are not important to the present invention, such details being principally of ornamental significance.

The cover illustrated in FIGS. 3 through 5 has an inner compartment 62 defining an enclosure for the upper portion of the lifting mechanism 24. The cover has an arcuate top wall 64 (FIGS. 3 and 5) that blends into each of two flat side walls 66*a* and 66*b*, as shown in FIG. 3. The cover also has vertically disposed flat front walls 68*a* and an identical back wall 68*b*, as shown in FIGS. 4 and 5. A portion of the front wall 68*a* is recessed as shown at 70*a* in FIGS. 4 and 5. The back wall has a similar recess depicted at 70*b*. The arm portions 36*a* and 36*b* of the bracket 30 cooperate with the side walls 66*a* and 66*b* of the cover to prevent rotation of the cover relative to the bracket when the shaft 50 is rotated.

Both the front wall 70*a* and the back wall 70*b* are provided with slots 72*a* (FIGS. 2 and 5) and 72*b* (FIG. 5), respectively. The slots 72*a* and 72*b* each extend vertically from an opening at the bottom of the associated recess 70*a* or 70*b* to an enlarged aperture 74*a* or 74*b*. The width of the slots 72*a* and 72*b* is less than the diameter of the shaft 50, as best illustrated in FIG. 2.

The cover 60 is attached to the shaft 50 by placing the cap over the shaft with the open ends of each of the slots 72*a* and 72*b* resting over portions of the shaft on either side of the bracket arm portions 36*a* and 36*b*. A downward pressure on the cover 60 will temporarily elastically deflect a portion of the cover to permit the shaft 50 to enter the slots 72*a* and 72*b*. As the downward pressure is continued, the shaft 50 will advance along the slots 72*a* and 72*b* until the shaft enters into the enlarged apertures 74*a* and 74*b*. When the shaft 50 is seated in the enlarged apertures 74*a* and 74*b*, the elastically deflected portion of the cover will relax partially or totally (depending on the diameter of the apertures), to secure the cap in position.

Removal of the cover is accomplished by manually grasping the cover at the lower portion 76*a* and 76*b* of the side walls 66*a* and 66*b*, respectively and applying an upward force. The upward force similarly elastically deflects the cover 60 to permit the shaft 50 to travel along the slots 72*a* and 72*b*.

Figure 7:
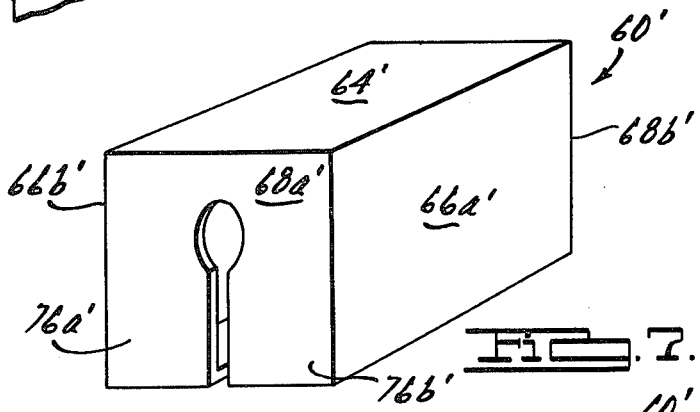
FIG. 7 is a perspective view of the cover of FIG. 6.
Figure 6:
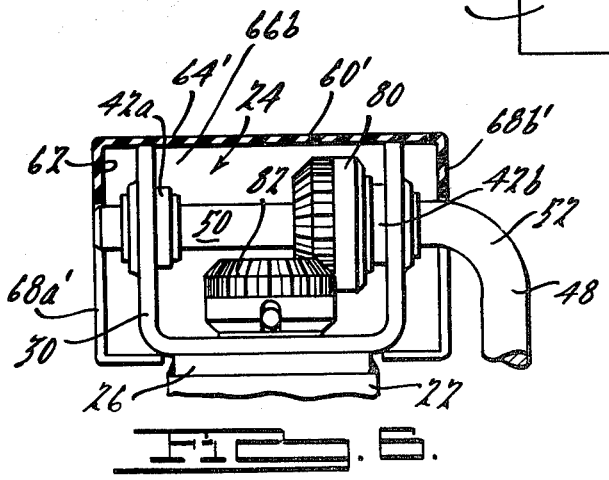
FIG. 6 is a view similar to FIG. 5 but illustrating an implement jack with a modified cover.
Figure 8:
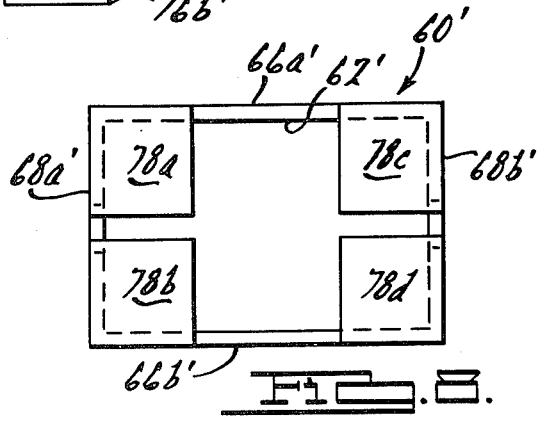
FIG. 8 is a bottom view thereof.

An alternate cover 60' is depicted in FIGS. 6 through 8. The alternate cover has a inner compartment 62' defined by a rectangular top 64', a flat rectangular side walls 66*a'* and 66*b'*, a flat front wall 68*a'* and flat a back wall 68*b'*. The cover 60' is also provided with flanges 78*a* through 78*d* (FIG. 8) which provide further protection to the lifting mechanism 24 against the environment. The flanges 78*a* through 78*d* deflect resiliently to permit removal and attachment of the cover 60'. The flanges 78*a* through 78*d* also help to secure the cover 60' against unintentional separation from the lifting jack 10. The flanges 78*a* through 78*d* are secondary, however, to the sloted walls 68*a'* and 68*b'* which walls offer the primary resistance against removal of the cover 60.

A first bevel gear 80 (FIGS. 4, 5 and 6) is pivotally mounted to the shaft 50 between the bushings 42*a* and 42*b*. The gear 80 is keyed or is otherwise constrained to rotate with the shaft 50. A second bevel gear 82 is provided at a right angle to the first gear 80 and in engagement with the first gear. The second gear 82 rests on a thrust bearing 83 which rests on the central portion 32 of the bracket 30.

A lead screw 84 (FIGS. 3 and 5) is fastened at one of its ends to the second gear 82. The lead screw 84 extends downwardly from the gear 82 through suitable apertures, not illustrated, in the thrust bearing 83, in the central portion 32 of the bracket 30 and in the plate 26. The lead screw 84 extends downwardly along the common longitudinal axis of the frame members 18 and 22 partly through the center of the frame members. A ball bearing assembly 86 is supported on a shoulder 88 of the lead screw 84 located below the plate 26. As will be explained later, the shoulder 88 supports the load that is to be lifted by the jack 10.

Figure 9:
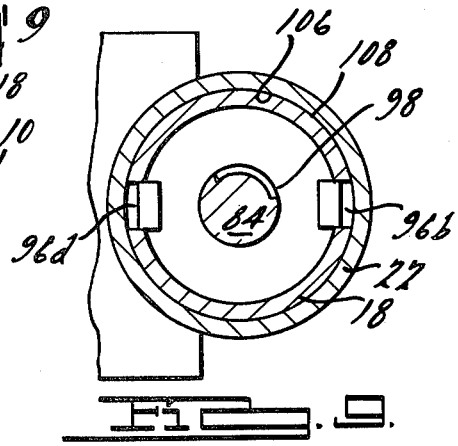
FIG. 9 is a sectional view taken along line 9—9 of FIG. 5.

A nut 90 (FIGS. 5 and 9) is interconnected with the first tubular member 18 near its uppermost end 92. In the example illustrated, the nut 90 is provided with an annular shoulder 94. The shoulder 94 cooperates with several tabs 96*a* through 96*d*, each extending from the member 18. The tabs 96*a* through 96*d* lock the nut 90 in position and prevent the nut 90 from rotating relative to the frame member 18. In the example illustrated, the tabs 96*a* through 96*d* are formed integrally with the first frame member and are temporarily elastically deflected for attachment of the nut 90. The nut 90 is provided with an internal thread, not illustrated but well known in the art, which cooperates with an external thread 98 on the lead screw 84. When the lead screw 84 is rotated, it translates along its longitudinal axis relative to the nut 60.

As shown in FIG. 5, an aperture 100 is provided in the upper portion 102 of the cylindrical wall of the second frame member 22. A grease fitting 104 is provided in the aperture 100 to permit grease to be tapped into the interior of the second frame member 22. The grease is used to lubricate the inner wall 106 of the second frame member 22 and the outer wall 108 of the first frame member 18 as well as portions of a lifting mechanism 24 within the frame members 18 and 22.

A bracket 110, illustrated in FIGS. 1, 2 and 5, is provided for interconnecting the second frame member 22 of the lifting jack with a load. The bracket 110 has a first bracket member consisting of a U-shaped stamping 112. As shown in FIG. 5, a pair of identical partial circular cutaways 114*a* and 114*b* are provided in the arms of the stamping 112. The bracket 110 is welded to the second frame member 22 by means of welds 116. An aperture 118 is provided in the central portion of the stamping 112. The bracket 110 has a second bracket member consisting of a length of tube 120. The tube 120 is welded, as shown at 122, to the stamping 112 so that the passageway therethrough is aligned with the aperture 118. The tube 120 is further provided with aligned apertures 132*a* and 132*b* in its rectanglar walls.

A chain 124 (FIG. 1) is fastened at one of its ends 126 to the stamping 112 of the bracket 110. The other end of the chain 124 is fastened to a ring 128 which is interconnected with one end of a locking pin 128. The pin 128 is selectively insertable into apertures 132*a* and 132*b*.

Also illustrated in the drawing in FIGS. 1, 2 and 5 is a shaft 134 which is interconnected with the load. For ease of illustration, only a portion of the shaft 134 is shown in FIGS. 1 and 2. The portion of the shaft 134 not shown is interconnected, for example, by welds to a load. As illustrated in FIG. 5, the shaft 134 may be provided with apertures aligned 136*a* and 136*b*. The pin 130 may be used to temporarily lock the bracket 110 to the shaft 134 by being inserted in apertures 132*a* and 132*b* and apertures 136*a* and 136*b*.

In operation, the weight of the load is transmitted through the bracket 110, the upper frame member 22, the plate 26 and the ball bearing 86 to the shoulder 88 of the lead screw 84. The load is raised by manually imparting a counterclockwise rotation to the crank 48. The counterclockwise rotation of the crank 48 is transmitted through the bevel gears 80 and 82 to the lead screw 84. The lead screw 84 raises the shoulder 88 relative to the nut 90 and, thereby, raises the load relative to the ground.

It is readily apparent that the present invention provides an inexpensive manually operable lifting jack that is easy to service. The present invention further provides a lifting jack having an easily removable cover for the drive mechanism.

The above constitutes a detailed description of the best mode contemplated by the inventor at the time of filing for carrying out the present invention. Modifications and variations therefrom will be apparent to those skilled in the art and are intended to be included within the scope of the appended claims.

What is claimed as novel is as follows:

1. A lifting jack for lifting a load, said lifting jack comprising a first frame member capable of resting on the ground, a second frame member movably interconnected with said first frame member, interconnecting means capable of interconnecting said second frame member and said load, selectively operable drive means capable of selectively displacing said second frame member relative to said first frame member and, thereby capable of selectively lifting said load when said first frame member is resting on the ground and said second frame member is interconnected with said load, a shaft interconnected with said load, said shaft interconnected with said drive means and selectively rotatable to operate said drive means, a cover for said drive means, said cover eremovably interconnected to said drive shaft; said cover having a lower portion with aligned apertures and slots extending from each aperture to an open end of said cover; said slots having a width less than the diameter of said aperture; said cover being made of resilient material such that said lower portion on each side of each slot being deformable for insertion of a portion of said shaft and being restorable to an undeflected position when said shaft is within said aperture.

2. The lifting jack of claim 1 wherein said second frame member has a longitudinal passageway therethrough and said first frame member is at least partly inserted into said longitudinal passageway whereby said second frame member moves relative to said first frame member by sliding along said longitudinal passageway.

3. The lifting jack of claim 1 wherein said drive means comprises a nut fixedly attached to one of said frame members and a lead screw rotatably attached to the other of said frame members and threaded into said nut whereby said second frame member is moved relative to said first frame member by means of rotation of said lead screw.

4. The jack of claim 3 wherein said drive means further comprises first gear means on said lead screw and second gear means on said drive shaft cooperating with said first gear means to deliver angular motion from said drive shaft to said lead screw.

5. The jack of claim 1 further comprising a manually operable crank interconnected with said drive shaft for manual rotation thereof.

6. A protective cover for a lifting jack having a first frame member, a second frame member movably interconnected with said first frame member, selectively operable drive means capable of selectively moving said second frame member relative to said first frame member, and a shaft interconnected with said drive means and selectively rotatable to operate said device means, said protective cover comprising a cover main body, a cavity in said cover main body capable of accepting therein a portion of drive means and a portion of said shaft, and interconnection means removably interconnecting said cover with said shaft in a position such that said portion of said drive means and said shaft are within said cavity; said cover having a lower portion with aligned apertures and slots extending from each aperture to an open end of said cover; said slots having a width less than the diameter of said aperture; said cover being made of resilient material such that said lower portion on each side of each slot being deformable for insertion of a portion of said shaft and being restorable to an undeflected position when said shaft is within said aperture.

* * * * *